US010751998B2

(12) United States Patent
Kato

(10) Patent No.: US 10,751,998 B2
(45) Date of Patent: Aug. 25, 2020

(54) LIQUID DISCHARGE HEAD, LIQUID DISCHARGE DEVICE, LIQUID DISCHARGE APPARATUS, AND HEAD MODULE

(71) Applicant: Masaki Kato, Tokyo (JP)

(72) Inventor: Masaki Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/285,428

(22) Filed: Feb. 26, 2019

(65) Prior Publication Data

US 2019/0275793 A1 Sep. 12, 2019

(30) Foreign Application Priority Data

Mar. 12, 2018 (JP) ..... 2018-043802
Jan. 18, 2019 (JP) ..... 2019-006704

(51) Int. Cl.

| | |
|---|---|
| ***B41J 2/175*** | (2006.01) |
| ***B41J 2/145*** | (2006.01) |
| ***B41J 2/18*** | (2006.01) |
| ***B41J 2/14*** | (2006.01) |

(52) U.S. Cl.

CPC ..... *B41J 2/145* (2013.01); *B41J 2/14233* (2013.01); *B41J 2/175* (2013.01); *B41J 2/18* (2013.01); *B41J 2202/12* (2013.01); *B41J 2202/20* (2013.01)

(58) Field of Classification Search

CPC . B41J 2/145; B41J 2/14233; B41J 2/18; B41J 2/175; B41J 2202/20; B41J 2202/12

See application file for complete search history.

(56) References Cited

U.S. PATENT DOCUMENTS

| | | | | |
|---|---|---|---|---|
| 2009/0102907 | A1* | 4/2009 | Yamanaka | B41J 2/055 347/94 |
| 2014/0036007 | A1* | 2/2014 | Sasaki | B41J 2/175 347/85 |
| 2017/0001441 | A1 | 1/2017 | Kato | |
| 2017/0151782 | A1* | 6/2017 | Takahashi | B41J 2/14233 |

FOREIGN PATENT DOCUMENTS

| | | |
|---|---|---|
| JP | 2002-307676 | 10/2002 |
| JP | 2006-082394 | 3/2006 |
| JP | 2014-030939 | 2/2014 |
| JP | 2014-166755 | 9/2014 |
| JP | 2015-036238 | 2/2015 |
| JP | 2016-179555 | 10/2016 |

* cited by examiner

*Primary Examiner* — Yaovi M Ameh
(74) *Attorney, Agent, or Firm* — Harness, Dickey & Pierce, P.L.C.

(57) ABSTRACT

A liquid discharge head includes a plurality of nozzles to discharge a liquid; a plurality of pressure chambers communicating with the plurality of nozzles; a plurality of individual supply channels communicating with the plurality of pressure chambers; a plurality of supply ports communicating with the plurality of individual supply channels; a plurality of common-supply branch channels communicating with two or more of the plurality of individual supply channels through the plurality of supply ports; a common-supply main channel communicating with the plurality of common-supply branch channels; and a plurality of supply-side dampers, each of the plurality of supply-side dampers forming a part of a wall of each of the plurality of common-supply branch channels.

14 Claims, 18 Drawing Sheets

LIQUID DISCHARGE HEAD, LIQUID DISCHARGE DEVICE, LIQUID DISCHARGE APPARATUS, AND HEAD MODULE

CROSS-REFERENCE TO RELATED APPLICATIONS

This patent application is based on and claims priority pursuant to 35 U.S.C. § 119(a) to Japanese Patent Application No. 2018-043802, filed on Mar. 12, 2018, and Japanese Patent Application No. 2019-006704, filed on Jan. 18, 2019, in the Japan Patent Office, the entire disclosure of each of which is hereby incorporated by reference herein.

BACKGROUND

Technical Field

The present disclosure relates to a liquid discharge head, liquid discharge device, a liquid discharge apparatus, and a head module.

Related Art

A liquid discharge head that discharges a liquid has to reduce crosstalk, in which fluctuation of pressure due to discharge of a liquid affects discharge characteristics of other pressure chambers (individual chambers) via a common channel.

A liquid discharge head is known that includes a pressure chamber communicating with a plurality of nozzles, a supply channel communicating with the pressure chamber, a plurality of branch channels connected to the supply channel via an opening, and a main channel connected to the plurality of branch channels. The nozzles are arranged two-dimensionally in a matrix. The liquid discharge head includes a damper constituting a part of a branch channel. The damper is a membrane that faces an opening of the supply channel.

SUMMARY

In an aspect of this disclosure, an improved liquid discharge head includes a plurality of nozzles to discharge a liquid, a plurality of pressure chambers communicating with the plurality of nozzles, a plurality of individual supply channels communicating with the plurality of pressure chambers, a plurality of supply ports communicating with the plurality of individual supply channels, a plurality of common-supply branch channels communicating with two or more of the plurality of individual supply channels through the plurality of supply ports, a common-supply main channel communicating with the plurality of common-supply branch channels, and a plurality of supply-side damper forming a part of wall of the plurality of common-supply branch channels. The plurality of nozzles includes a first nozzle and a second nozzle disposed closest to the first nozzle. The plurality of supply ports includes a first supply port communicating with the first nozzle and a second supply port communicating with the second nozzle. The first supply port and the second supply port are arranged in an identical one of the plurality of common-supply branch channels. The first supply port and the second supply port are spaced apart by a distance greater than a distance between one of the first supply port and the second supply port and one of the plurality of supply-side damper facing one of the first collection port and the second collection port.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
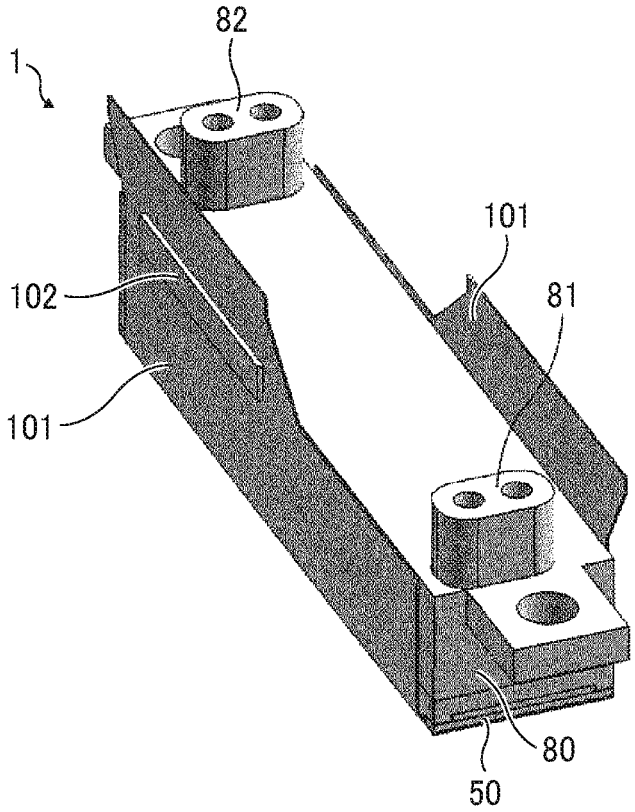
FIG. 1 is an external perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings.

A first embodiment of the present disclosure is described with reference to FIGS. 1 to 8.

Figure 2:
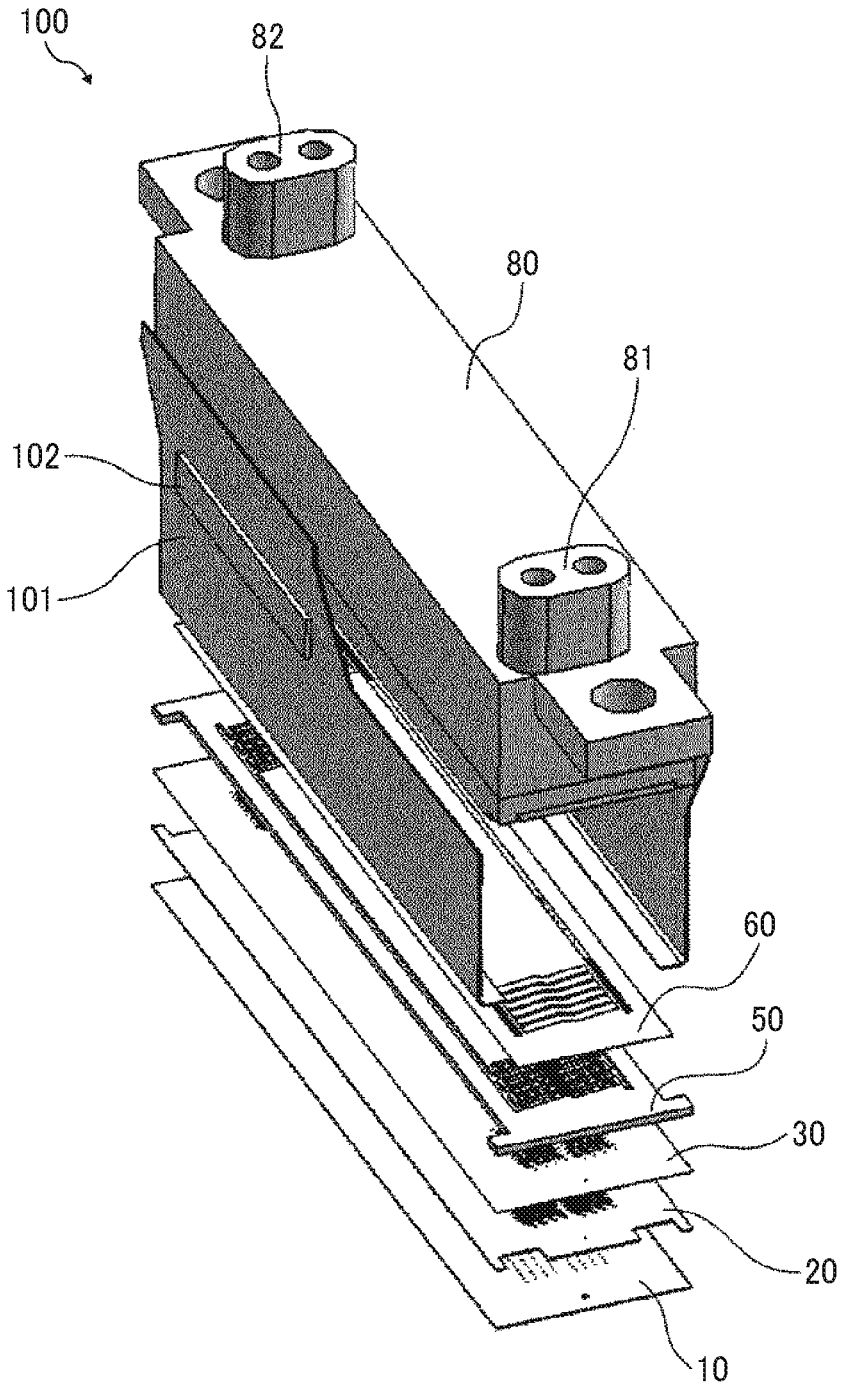
FIG. 2 is an exploded perspective view of the liquid discharge head of FIG. 1.
Figure 3:
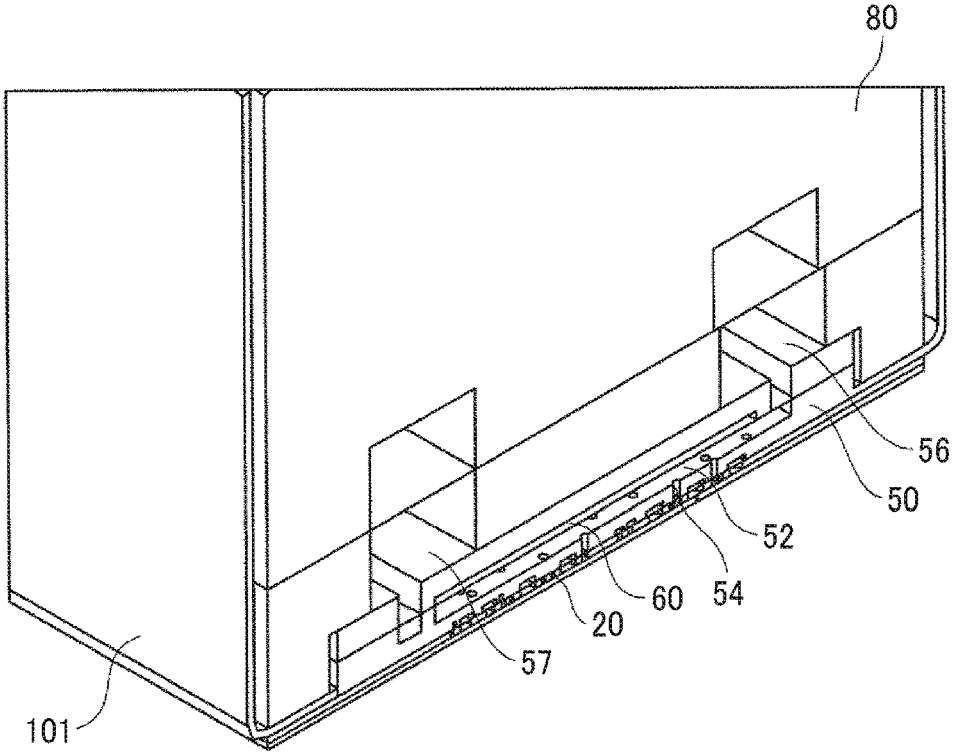
FIG. 3 is a cross-sectional perspective view of the liquid discharge head of FIG. 1.
Figure 4:
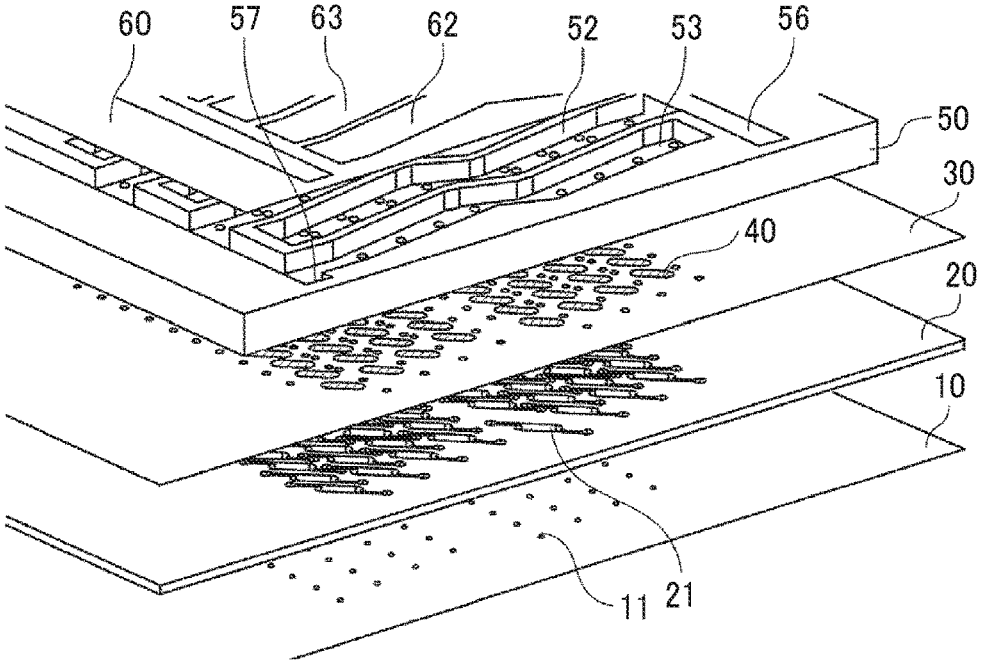
FIG. 4 is an exploded perspective view of the liquid discharge head without a frame of FIG. 3.
Figure 5:
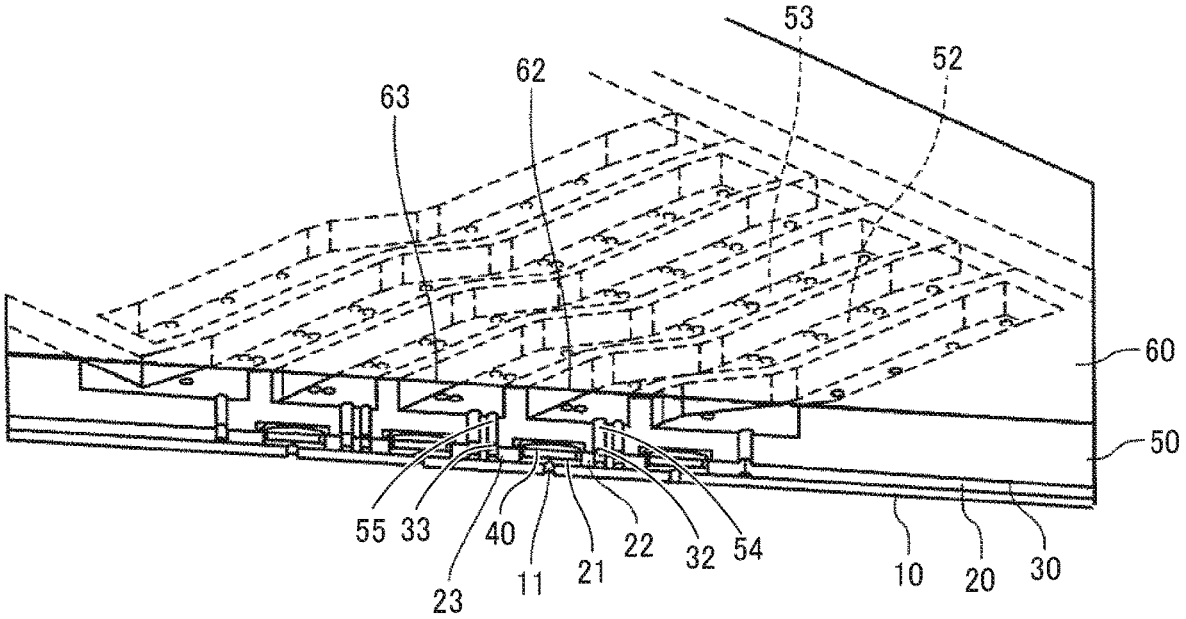
FIG. 5 is a cross-sectional perspective view of channels in the liquid discharge head of FIG. 3.
Figure 6:
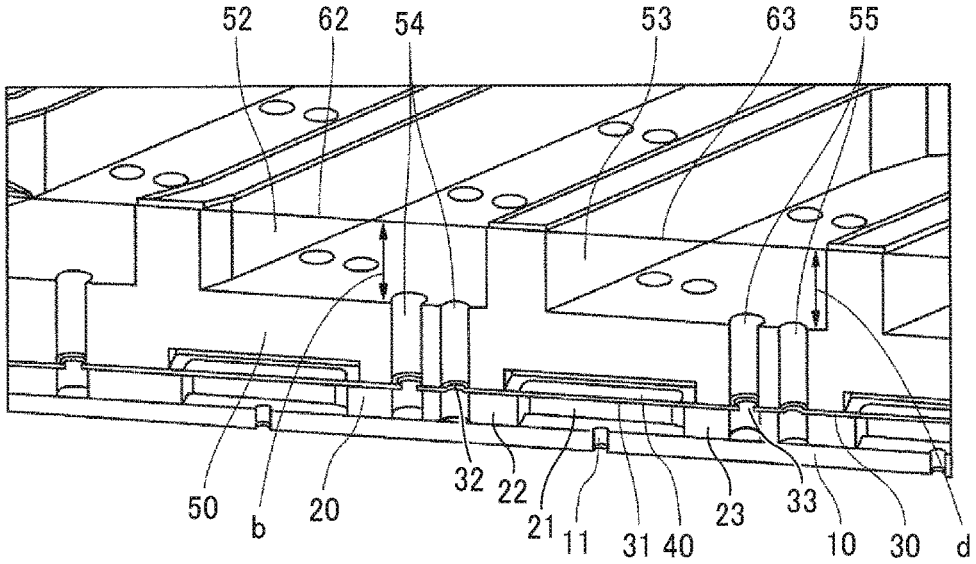
FIG. 6 is an enlarged cross-sectional perspective view of the channels in the liquid discharge head of FIG. 5.
Figure 7:
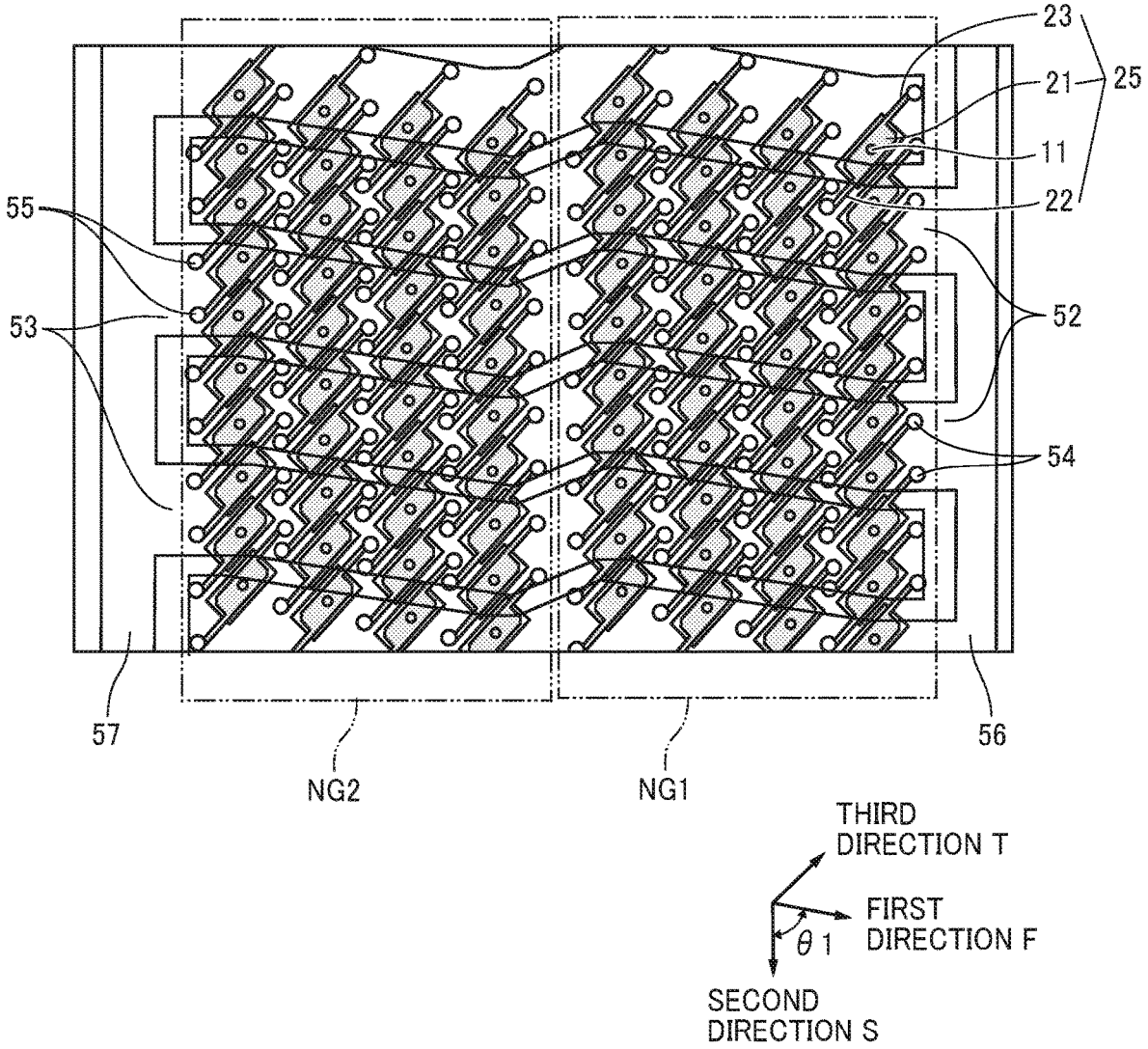
FIG. 7 is a plan view of the channels in the liquid discharge head of FIG. 5.
Figure 8:
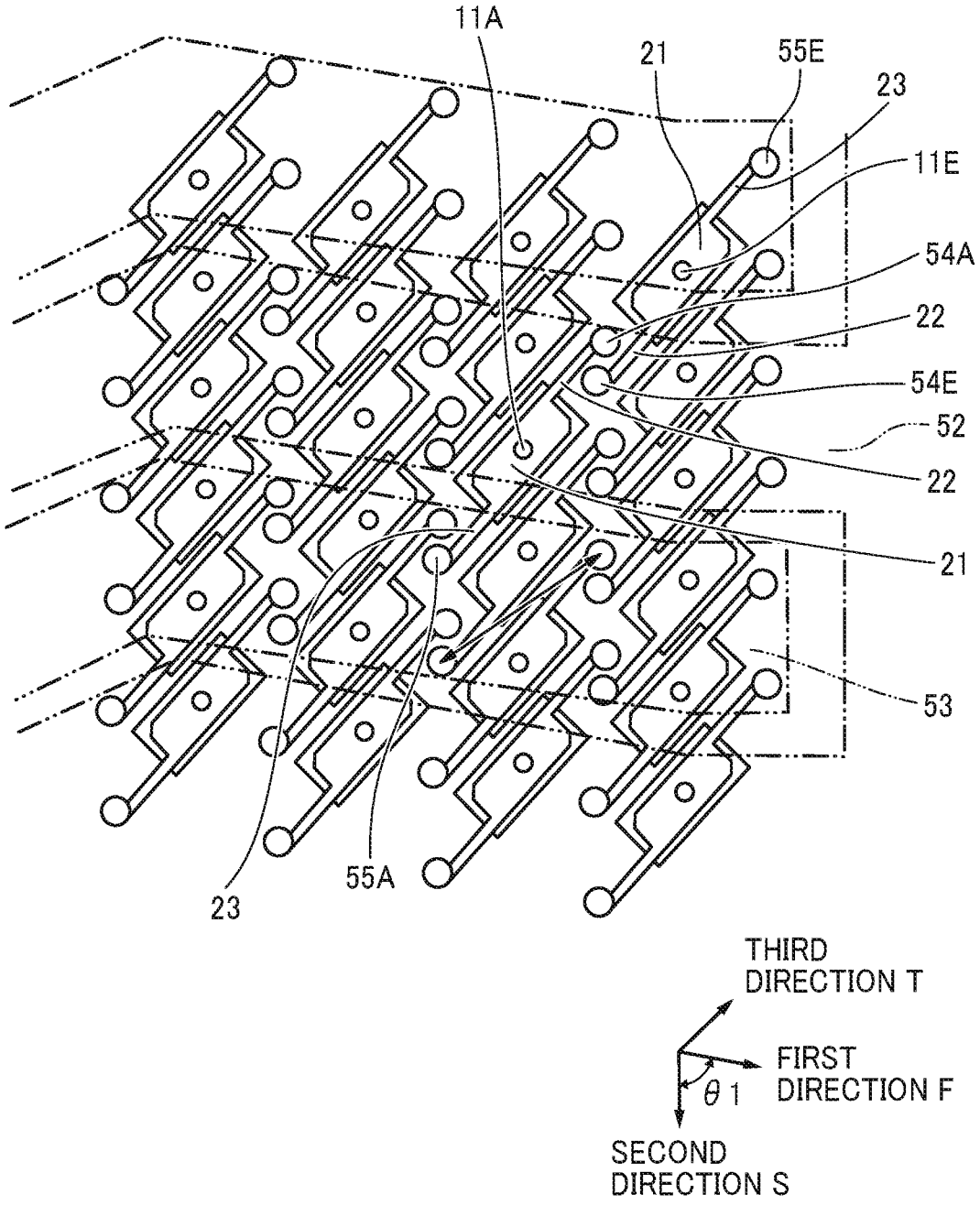
FIG. 8 is an enlarged plan view of a portion of the liquid discharge head of FIG. 7.

FIG. 1 is an outer perspective view of a liquid discharge head 1 according to the present disclosure. FIG. 2 is an exploded perspective view of the liquid discharge head 1. FIG. 3 is a cross-sectional perspective view of the liquid discharge head 1. FIG. 4 is an exploded perspective view of the liquid discharge head 1 excluding a frame. FIG. 5 is a cross-sectional perspective view of channels of the liquid discharge head 1. FIG. 6 is an enlarged cross-sectional perspective view of another example of the channels of the liquid discharge head 1. FIG. 7 is a plan view of the channels of the liquid discharge head 1. FIG. 8 is an enlarged plan view of a portion of the liquid discharge head of FIG. 7.

The liquid discharge head 1 includes a nozzle plate 10, an individual channel member 20 (channel plate), a diaphragm member 30, a common channel member 50, a damper 60, a frame 80, and a flexible wiring member 101 (substrate) mounting a drive circuit 102 (flexible wiring substrate). Hereinafter, the "liquid discharge head" is simply referred to as the "head".

The nozzle plate 10 includes a plurality of nozzles 11 to discharge liquid. As illustrated in FIG. 1, the plurality of nozzles 11 are arranged two-dimensionally in a matrix and are arranged side by side in three directions of a first direction F, a second direction S and a third direction T.

The individual channel member 20 includes a plurality of pressure chambers 21 (individual chambers) respectively communicating with the plurality of nozzles 11, a plurality of individual supply channels 22 respectively communicating with the plurality of pressure chambers 21, and a plurality of individual collection channels 23 respectively communicating with the plurality of pressure chambers 21.

A combination of one pressure chamber 21, one individual supply channel 22 communicating with one pressure chamber 21, and one individual collection channel 23 communicating with one pressure chamber 21 is collectively referred to as an individual channel 25.

The diaphragm member 30 forms a diaphragm 31 serving as a deformable wall of the pressure chamber 21, and the piezoelectric element 40 is formed on the diaphragm 31 to form a single body.

Further, a supply-side opening 32 communicating with the individual supply channel 22 and a collection-side opening 33 communicating with the individual collection channel 23 are formed on the diaphragm member 30. The piezoelectric element 40 is a pressure generator to deform the diaphragm 31 to pressurize the liquid in the pressure chamber 21.

Note that the individual channel member 20 and the diaphragm member 30 are not limited to being separate members. For example, an identical member such as a Silicon on Insulator (SOI) substrate may be used to form the individual channel member 20 and the diaphragm member 30 in a single body. That is, an SOI substrate formed by sequentially forming a silicon oxide film, a silicon layer, and a silicon oxide film on a silicon substrate is used. The silicon substrate in the SOI substrate forms the individual channel member 20, and the silicon oxide film, the silicon layer, and the silicon oxide film in the SOI substrate form the diaphragm 31. In the above-described configuration, the layer structure of the silicon oxide film, the silicon layer, and the silicon oxide film in the SOI substrate becomes the diaphragm member 30. As described above, the diaphragm member 30 includes a member made of the material that is film-formed on a surface of the individual channel member 20.

The common channel member 50 includes a plurality of common-supply branch channels 52 communicating with two or more individual supply channels 22 and a plurality of common-collection branch channels 53 communicating with two or more individual collection channels 23. The plurality of common-supply branch channel 52 and the plurality of common-collection branch channel 53 are alternately formed adjacent to each other in the second direction S of the nozzle 11 (see FIG. 7).

As illustrated in FIG. 6, the common channel member 50 includes a through-hole serving as a supply port 54 that connects the supply-side opening 32 of the individual supply channel 22 and the common-supply branch channel 52 and a through-hole serving as a collection port 55 that connects the collection-side opening 33 of the individual collection channel 23 and the common-collection branch channel 53.

Further, as illustrated in FIG. 6, the common channel member 50 includes one or more common-supply main channel 56 communicating with the plurality of common-supply branch channels 52 and one or more common-collection main channel 57 communicating with the plurality of common-collection branch channels 53.

The damper 60 includes a plurality of supply-side dampers 62 that faces (opposes) the plurality of supply ports 54 of the plurality of common-supply branch channels 52, respectively, and a plurality of collection-side dampers 63 that faces (opposes) the plurality of collection ports 55 of the plurality of common-collection branch channels 53, respectively.

As illustrated in FIGS. 5 and 6, the plurality of common-supply branch channels 52 and the plurality of common-collection branch channels 53 are formed by sealing grooves formed on an identical common channel member 50 with the identical damper member (damper 60) including the plurality of supply-side dampers 62 and the plurality of collection-side dampers 63.

The grooves forming the plurality of common-supply branch channels 52 and the plurality of common-collection branch channels 53 alternate in the common channel member 50. As a material of the damper 60 (identical damper member), it is preferable to use a metal thin film or an inorganic thin film resistant to an organic solvent. A thickness of the supply-side damper 62 and the collection-side damper 63 of the damper 60 is preferably 10 μm or less.

Thus, the plurality of supply-side dampers 62 and the plurality of collection-side dampers 63 are formed by an identical damper member (damper 60) such as the metal thin film or the inorganic thin film. Each of the plurality of common-supply branch channels 52 and the plurality of common-collection branch channels 53 is formed by sealing grooves formed on an identical common channel member 50 with the identical damper member (damper 60).

Next, an arrangement of the channels in the present disclosure is described with reference also to FIGS. 8 to 11.

FIGS. 8 to 11 are enlarged cross-sectional views of a portion of the head 1 of FIG. 7. In FIGS. 8 to 11, branch channels such as the common-supply branch channels 52 and the common-collection branch channels 53 are indicated by imaginary lines.

As illustrated in FIG. 8, the plurality of nozzles 11 are arranged two-dimensionally in a matrix and are arranged side by side in three directions of a first direction F, a second direction S and a third direction T. As illustrated in FIG. 7, a group of the nozzles 11 arranged two-dimensionally in a matrix is defined as a nozzle group NG (NG 1 and NG 2).

In one nozzle group NG (NG 1 or NG 2, for example), an array of the plurality of nozzles 11 in which the plurality of nozzles 11 are arranged in the second direction S is referred to as a "nozzle array". Then, the first direction F becomes a direction in which nozzle arrays are aligned at a predetermined inclination angle θ1 with respect to a direction of arrangement of the nozzles 11 (second direction S). The common-supply branch channel 52 and the common-collection branch channel 53 extend in the first direction F. Therefore, a longitudinal direction of the common-collection branch channel 52 and the common-collection branch channel 53 is along the first direction F.

In one nozzle group NG (NG 1 or NG 2, for example), the second direction S is a direction (nozzle array direction) in which closest nozzles 11 are arranged (arrayed) and is a direction intersecting the first direction F at an angle θ1 in the first direction F. Thus, the common-supply branch channel 52 and the common-collection branch channel 53 alternate in the second direction S.

In one nozzle group NG (NG 1 or NG 2, for example), the third direction T is a direction intersecting the first direction F and the second direction S. In the present disclosure, the individual channels 25 configured by the individual supply channel 22, the pressure chambers 21, and the individual collection channels 23 is arranged along the third direction T.

The individual channel 25 configured by the individual supply channel 22, the pressure chamber 21, and the individual collection channel 23 has a shape of twice rotational symmetrical with an axis of the nozzle 11 (central axis in a direction of liquid discharge from the nozzle 11).

The individual channel 25 has the shape of twice rotational symmetry with the axis of nozzles 11. The individual channel 25 communicating with the nozzle 11A (first nozzle) and the individual channel 25 communicating with the nozzle 11E have a relation in which a direction of liquid flow in the individual channel 25 of the nozzle 11A is opposite (reverse) to a direction of liquid flow in the individual channel 25 of the nozzle 11E.

For example, the direction of liquid flow in the individual channel 25 of the nozzle 11A is from a supply port 54A to a collection port 55A, and the direction of liquid flow in the individual channel 25 of the nozzle 11E is from a supply port 54E to a collection port 55E.

Thus, in an example illustrated in FIG. 8, the individual channels 25 of the nozzles 11A and 11E adjacent in a direction (third direction T) parallel to the direction of liquid flow in the individual channel 25 can be reversely arranged such that the liquid in the individual channel 25 of the nozzle 11A flows in a direction opposite (reverse) to the liquid flowing in the individual channel 25 of the nozzle 11E.

The supply port 54A communicating with the individual channel 25 of the nozzle 11A and the supply port 54E communicating with the individual channel 25 of the nozzle 11E are arranged in the identical common-supply branch channel 52. Further, a direction of arrangement of the individual channel 25 communicating with the supply port 54A can be arranged opposite (reverse) to a direction of arrangement of the individual channel 25 communicating with the supply port 54E.

Thus, a package density of the individual channels 25 (nozzles 11) can be increased without being restricted by an arrangement of the common-supply branch channel 52, and the head 1 thus can be downsized.

Further, in the example illustrated in FIG. 8, the nozzle 11A connected to the supply port 54A and the nozzle 11E connected to the supply port 54E communicate with different common-collection branch channels 53 through collection ports 55A and 55E, respectively. Thus, two nozzles communicating with two supply ports 54 arranged nearest to each other (closest to each other) and arranged in the identical common-supply branch channel 52 communicate with different common-collection branch channels 53 via two collection ports 55, respectively.

The individual channels 25 are translationally symmetrical (not reversely arranged) in the first direction F along which the liquid flows in the common-supply branch channel 52 and the common-collection branch channel 53.

Figure 9:
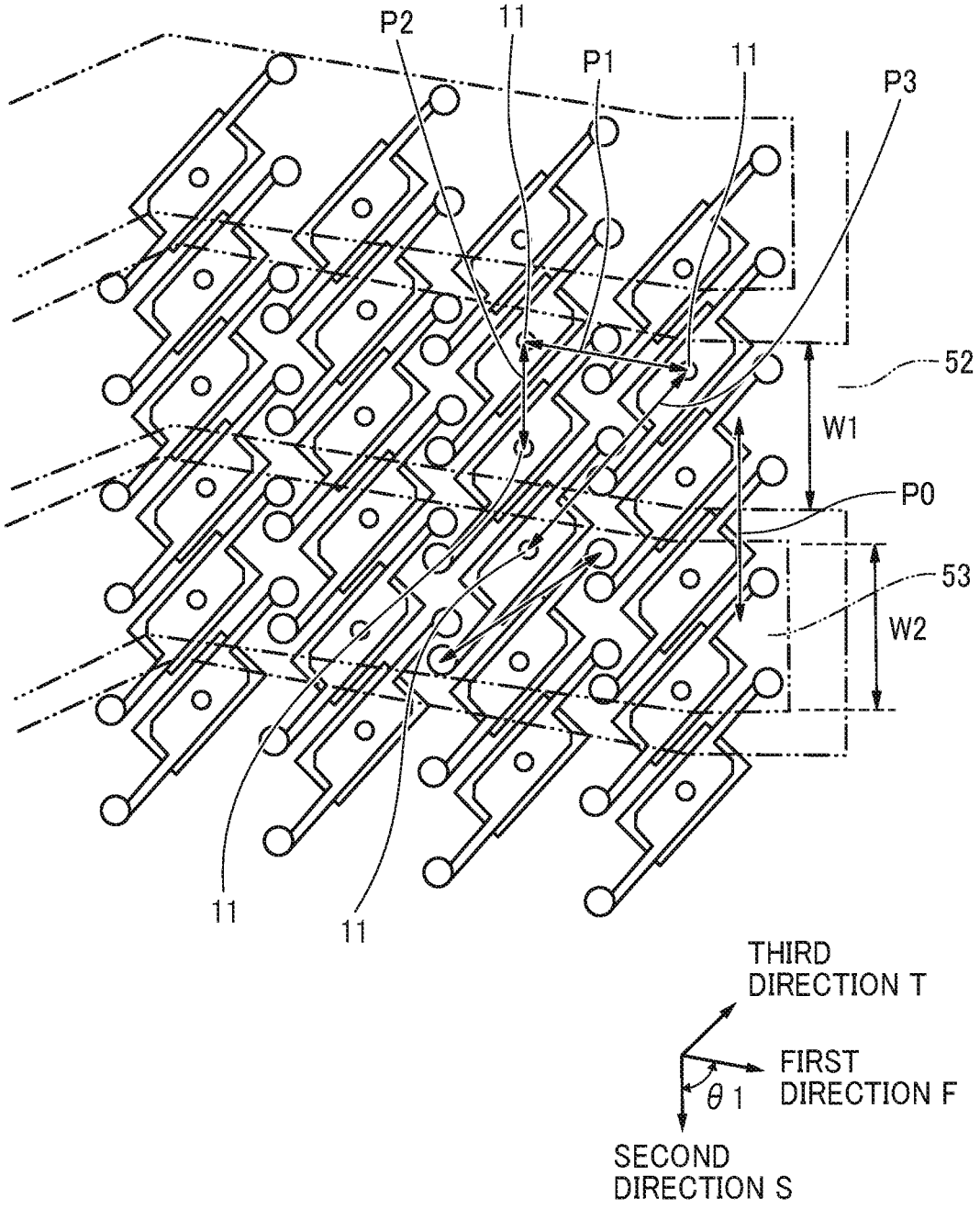
FIG. 9 is an enlarged plan view of a portion of the liquid discharge head of FIG. 7.

As illustrated in FIG. 9, an interval P3 between the nozzles 11 adjacent in the third direction T can be set in an arbitrary direction. However, the interval P3 can be set wider than an interval P1 between the nozzles 11 adjacent in the first direction F and an interval P2 between the nozzles 11 adjacent in the second direction T.

The third direction T is set such that the interval P3 between the nozzles 11 adjacent in the third direction T has a distance equal to or more than twice the interval P2 between the nozzles 11 adjacent in the second direction S. Further, an interval PO between the common-supply branch channel 52 and the common-collection branch channel 53 is set to be twice or more the interval P2 of the nozzles 11 adjacent in the second direction S.

In the present disclosure, the interval PO corresponds to a center distance between a width of channels in a direction along which the common-supply branch channel 52 and the common-collection branch channel 53 alternate (second direction S).

Further, a width W1 of the common-supply branch channel 52 is made wider (twice or more) than the interval P2 of the nozzles 11 adjacent in the second direction S. Similarly, a width W2 of the common-collection branch channel 53 is also made wider (twice or more) than the interval P2 of the nozzles 11 adjacent in the second direction S.

Figure 10:
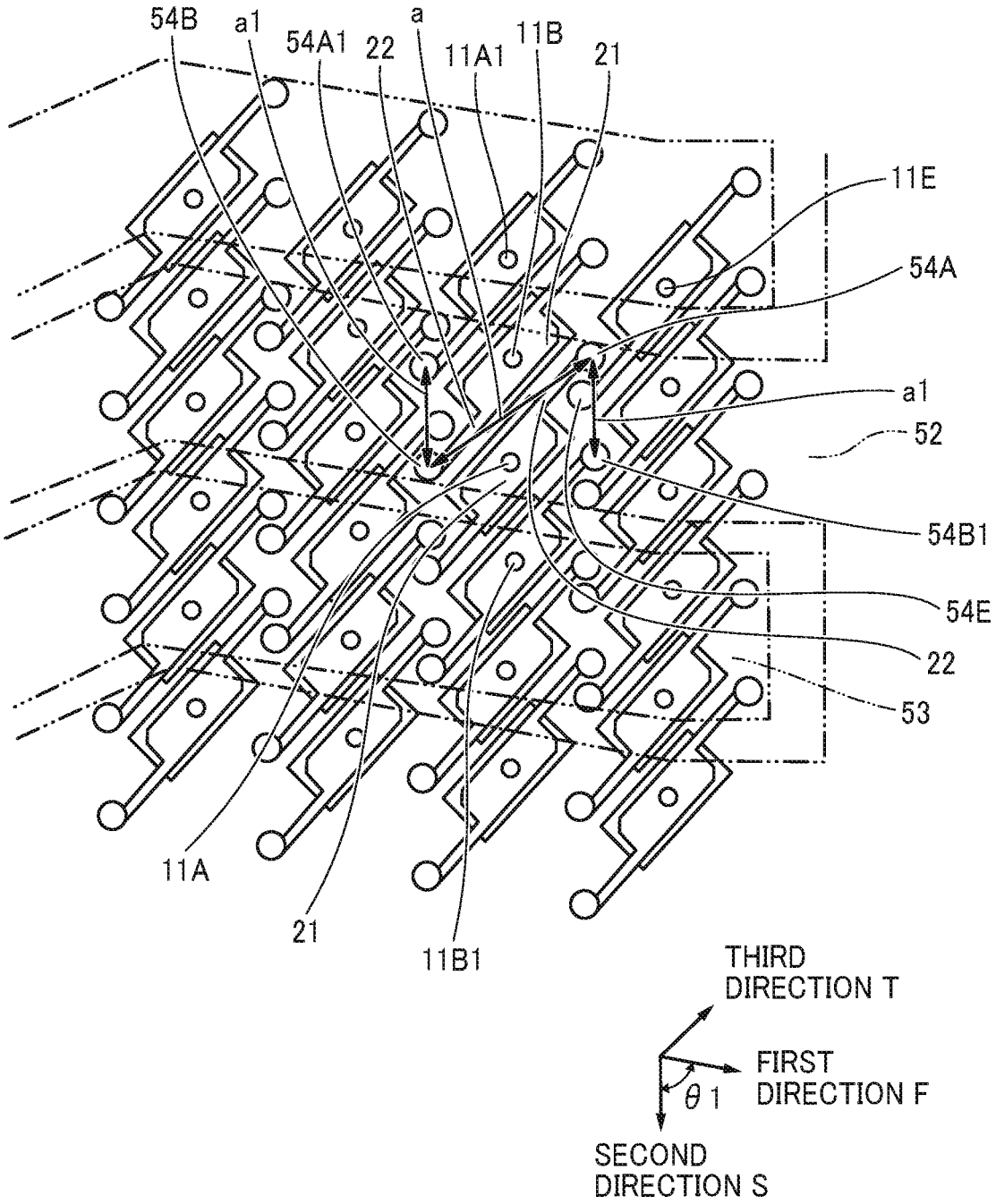
FIG. 10 is an enlarged plan view of a portion of the liquid discharge head of FIG. 7.

Following describes a relation between a distance "a" and a distance "b". FIG. 10 illustrates the distance "a" between the supply ports 54 of two closest nozzles 11 among the nozzles 11 communicating with the identical common-supply branch channel 52. FIG. 6 illustrates the distance "b" from the supply port 54 to a supply-side damper 62.

Here, a combination of the closest nozzles 11 among two adjacent nozzles 11 is defined as a first nozzle 11A and a second nozzle 11B, respectively. In FIG. 10, the nozzles 11A and 11B arranged in the second direction S are combinations of the closest nozzles 11 in the same row (array).

The supply port 54 communicating with the first nozzle 11A is referred to as a "first supply port 54A", and the supply port 54 communicating with the second nozzle 11B is referred to as a "second supply port 54B". The first supply port 54A communicating with the first nozzle 11A and the second supply port 54B communicating with the second nozzle 11B are arranged in the identical common-supply branch channel 52.

A distance "a" between the first supply port 54A and the second supply port 54B is greater than a distance "b" (see FIG. 6) from the supply port 54 (the first supply port 54A or the second supply port 54B) to the supply-side damper 62 (a>b).

Further, in the present disclosure, the first nozzle 11A is the closest nozzle to a second nozzle 11B1 in the second direction S. The second nozzle 11B1 is arranged opposite to the second nozzle 11B via the first nozzle 11A in the second direction S. Therefore, a distance "al" between the first supply port 54A communicating with the first nozzle 11A and a second supply port 54B1 communicating with the second nozzle 11B1 is also greater than the distance "b" from the supply port 54 to the supply-side damper 62 (al>b).

Similarly, in the present disclosure, the second nozzle 11B is the closest nozzle to a first nozzle 11A1 in the second direction S. The first nozzle 11A1 is arranged opposite to the first nozzle 11A via the second nozzle B in the second direction S. Thus, the distance "al" between the first supply port 54A1 communicating with the first nozzle 11A1 and the second supply port 54B communicating with the second nozzle 11B is also greater than the distance "b" from the supply port 54 to the supply-side damper 62 (al>b).

In this case, the first supply port 54A and the second supply port 54B are not the closest supply port 54. However, the first nozzle 11A and the second nozzle 11B are the closest nozzles belonging to the same array.

For example, the plurality of supply ports 54 further includes a third supply port 54B1, and the third supply port 54B1 is arranged in the identical one of the plurality of common-supply branch channels 52 with the first supply port 54A and the second supply port 54B. The third supply port 54B1 and one of the first supply port 54A and the second supply port 54B (first supply port 54A in FIG. 10) are spaced apart by a distance "al" shorter than the distance "a" between the first supply port 54A and the second supply port 54B. The nozzle 11B1 communicating with the supply port 54B1 is arranged in a different array from the nozzle 11A communicating with the supply port 54A.

The supply port 54E communicating with the nozzle 11E is the closest to the first supply port 54A as described above. The nozzle 11E is arranged in a different array from the first nozzle 11A and the second nozzle 11B.

In the head 1 with such a configuration, when the liquid in the pressure chamber 21 is pressurized and liquid is discharged from the nozzle 11, a pressure wave propagates from the individual supply channel 22 to the common-supply branch channel 52 through the first supply port 54A.

The distance "b" from the supply port 54 to the supply-side damper 62 is short. Thus, the pressure wave coming out from the first supply port 54A spreads in a spherical shape, extends to the supply-side damper 62, and is absorbed by the supply-side damper 62 before the pressure wave propagates and extends to the second supply port 54B. Thus, the pressure wave reaching the second supply port 54B decreases.

Thus, the head 1 can reduce pressure interference (mutual interference) with other nozzles 11 through the common-supply branch channel 52 and thus can reduce crosstalk.

On the other hand, the supply port 54E of the nozzle 11E is the closest supply port 54 to the first supply port 54A. The pressure wave generated by the discharge operation of the liquid from the first nozzle 11A propagates through the supply port 54E and extends to the pressure chamber 21 of the nozzle 11E. However, the nozzle 11E is arranged in a different array from the first nozzle 11A and is not driven simultaneously with the nozzle 11A. Thus, the effect of crosstalk is reduced.

Configuring the channels as illustrated in FIG. 7 (FIGS. 8 to 11) can increase the density of nozzles and reduce crosstalk.

That is, in general, arranging the supply ports 54 such that a distance between all the supply ports 54 is larger than the distance "b" between the supply port 54 and the supply-side damper 62 can reduce crosstalk between adjacent nozzles. At the same time, however, increasing a distance between the supply ports 54 reduces the density of arrangement of the nozzles 11 and thus resulting in an increase in head size.

Therefore, the above-described arrangement of the channels can increase the package density of the individual channel 25 (arrangement of the nozzles 11) and downsize the head 1.

The distance "b" from the supply port 54 to the supply-side damper 62 should be as short as possible. Thus, the distance "b" is set to be the optimum size in consideration of a cross-sectional area of the common-supply branch channel 52. In this case, the common-supply branch channel 52 needs to secure a flow rate of the liquid equal to a flow rate of several minutes of the nozzles 11 connected to the common-supply branch channel 52 to distribute the liquid to each supply ports 54 connected to the same common-supply branch channel 52.

The distance "b" from the supply port 54 to the supply-side damper 62 corresponds to a height of the channel of the common-supply branch channel 52. Shortening the distance "b" between the supply port 54 and the supply-side damper 62 reduces a height of the channels of the common-supply branch channel 52. Further, shortening the distance "b" reduces a cross-sectional area of the common-supply branch channel 52 and increases a fluid resistance of the common-supply branch channel 52.

When the fluid resistance of the common-supply branch channel 52 is large, the variation of the pressure loss in the common-supply branch channel 52 becomes large when the flow rate in each nozzle 11 varies by discharging the liquid. When the pressure loss fluctuates greatly, the pressure at each nozzle 11 fluctuates according to the flow rate at each nozzle 11. Thus, discharge characteristic of the liquid at each nozzle 11 varies.

Thus, in the present disclosure, the channels of the head 1 is arranged as described above to make the width W1 of one common-supply branch channel 52 twice or more the interval P2 of the nozzles 11 in the second direction S. Thus, the above-described arrangement of channels of the head 1 increases the cross-sectional area of the common-supply branch channel 52 and reduces the fluid resistance of the common-supply branch channel 52.

In this way, the head 1 according to the present disclosure can reduce a fluid resistance and reduce crosstalk at the same time.

Further, widening the width W1 of the common-supply branch channel 52 increases the width of the supply-side damper 62 and increases a compliance of the supply-side damper 62. Therefore, the height of the common-supply branch channel 52 is sufficiently reduced, and the width of the common-supply branch channel 52 is sufficiently enlarged within an allowable range of the fluid resistance of the common-supply branch channel 52. Thus, the head 1 of the present disclosure can reduce the variation in discharge characteristics while reducing crosstalk.

Figure 11:
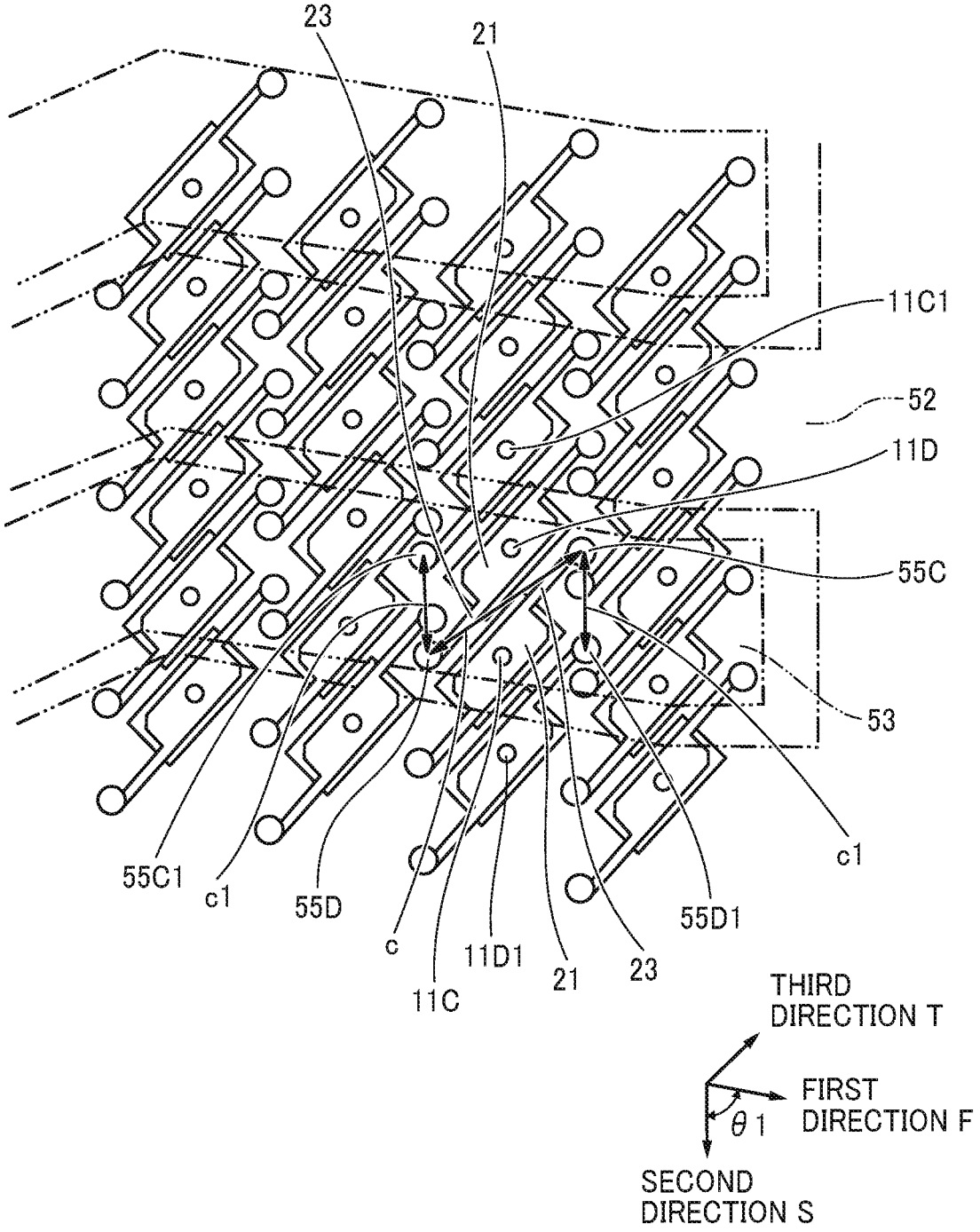
FIG. 11 is an enlarged plan view of a portion of the liquid discharge head of FIG. 7.

As illustrated in FIGS. 7 and 11, the channels according to the present disclosure are arranged to dispose the individual collection channel 23 opposite to the individual supply channel 22 via the pressure chamber 21. Further, the individual collection channel 23 is connected to the common-collection branch channel 53 via the collection port 55, and the plurality of common-collection branch channels 53 communicate with the common-collection main channel 57. Thus, the head 1 of the present disclosure constitutes the head 1 including a circulation-type individual chamber (pressure chamber). Thus, a liquid with high drying property or a liquid with high sedimentation property can be used to the head 1.

As described above, the common-supply branch channel 52 and the common-collection branch channel 53 alternate. On a wall of the common-collection branch channel 53, a collection-side damper 63 is disposed to face the collection port 55.

The pressure wave generated in the pressure chamber 21 at the time of discharging the liquid interferes not only with the supply-side nozzles 11 but also with the other nozzles 11 via the common-collection branch channel 53. Thus, similarly with the common-supply branch channel 52, variations in the discharge characteristics due to crosstalk occur via the common-collection branch channel 53.

Thus, on a wall of the common-collection branch channel 53, a collection-side damper 63 is disposed to face the collection port 55. Thus, the head 1 can reduce a crosstalk occurred via the common-collection branch channel 53.

Here, similarly to the supply-side channels, the combination of the closest nozzles 11 of the collection-side among the two adjacent nozzles 11 is referred to as a third nozzle 11C and a fourth nozzle 11D, respectively. In FIG. 11, the nozzles 11 arranged in the second direction S are combinations of the closest nozzles 11 in the same array.

The collection port 55 communicating with the third nozzle 11C is referred to as a "first collection port 55C", and the collection port 55 communicating with the fourth nozzle 11D is referred to as a "second collection port 55D". The first collection port 55C communicating with the third nozzle 11C and the second collection port 55D communicating with the fourth nozzle 11D are arranged in the identical common-collection branch channel 53.

A distance "c" between the first collection port 55C and the second collection port 55D is greater than a distance "d" (=b, see FIG. 6) from the collection port 55 (the first collection port 55C and the second collection port 55D) to the collection-side damper 63 (c>d).

Further, in the present disclosure, the third nozzle 11C is the closest nozzle to a fourth nozzle 11D1 in the second direction S. The fourth nozzle 11D1 is arranged opposite to the fourth nozzle 11D via the third nozzle 11C in the second direction S. Thus, the distance "cl" between the first collection port 55C communicating with the third nozzle 11C and a second collection port 55D1 communicating with the fourth nozzle 11D1 is also greater than the distance "d" (see FIG. 6) from the collection port 55 to the collection-side damper 63 (cl>d).

Further, in the present disclosure, the fourth nozzle 11D is the closest nozzle to a third nozzle 11C1 in the second direction S. The third nozzle 11C1 is arranged opposite to the third nozzle 11C via the fourth nozzle 11D in the second direction S. Thus, the distance "cl" between the first collection port 55C1 communicating with the third nozzle 11C1 and a second collection port 55D communicating with the fourth nozzle 11D is also greater than the distance "d" (see FIG. 6) from the collection port 55 to the collection-side damper 63 (cl>d).

In this case, the first collection port 55C and the second collection port 55D are not the closest collection port 55. However, the third nozzle 11C and the fourth nozzle 11D are the closest nozzles belonging to the same array.

For example, the plurality of collection ports 55 further includes a third collection port 55D1, and the third collection port 55D1 is arranged in the identical one of the plurality of common-collection branch channels 52 with the first collection port 55C and the second collection port 55D. The third collection port 55D1 and one of the first collection port 55C and the second collection port 55D (first collection port 55C in FIG. 11) are spaced apart by a distance "cl" shorter than the distance "c" between the first collection port 55C and the second collection port 55D. The nozzle 11C communicating with the collection port 55C is arranged in a different array from the nozzle 11D1 communicating with the collection port 55D1.

In the head 1 with such a configuration, when the liquid in the pressure chamber 21 is pressurized and liquid is discharged from the nozzle 11, a pressure wave propagates from the individual collection channel 23 to the common-collection branch channel 53 through the first collection port 55C. The pressure wave coming out of the first collection port 55C arrives at the collection-side damper 63 and is absorbed and attenuated before propagating to the second collection port 55D.

Thus, the head 1 can reduce pressure interference (mutual interference) with other nozzles 11 through the common-collection branch channel 53 and thus can reduce crosstalk.

Further, in the present disclosure, the common-supply branch channel 52 and the common-collection branch channel 53 alternate in the common channel member 50.

The above-described configuration of the head 1 enables formation of the supply-side damper 62 of the common-supply branch channel 52 and the collection-side damper 63 of the common-collection branch channel 53 with one damper 60, and thus enables to downsize the head.

Further, as described in FIG. 9, an interval PO between the common-supply branch channel 52 and the common-collection branch channel 53 is set to be twice or more of the interval P2 between the nozzles 11 adjacent in the second direction S. Similarly, with a width W1 of the common-supply branch channel 52, a width W2 of the common-collection branch channel 53 is also made wider (twice or more) than the interval P2 of the nozzles 11 in the second direction S.

Thus, also in the common-collection branch channel 53, the head 1 according to the present disclosure can increase a compliance of the collection-side damper 63 while reducing the fluid resistance and sufficiently shorten a distance between the collection-side damper 63 and the collection port 55.

Therefore, the head 1 can reduce crosstalk due to propagation of the pressure wave, can be used to various types of liquids by a circulation type head, and can provide better reliability.

Thus, the head 1 having the arrangement of the channels as described in FIGS. 7 to 11 can reduce the fluid resistance of the common-supply branch channel 52 and the common-collection branch channel 53. Further, the head 1 can increase the compliance of the damper disposed in the common-supply branch channel 52 and the common-collection branch channel. Thus, the head 1 can reduce a fluid resistance and reduce crosstalk at the same time to stably discharge the liquid.

Figure 12:
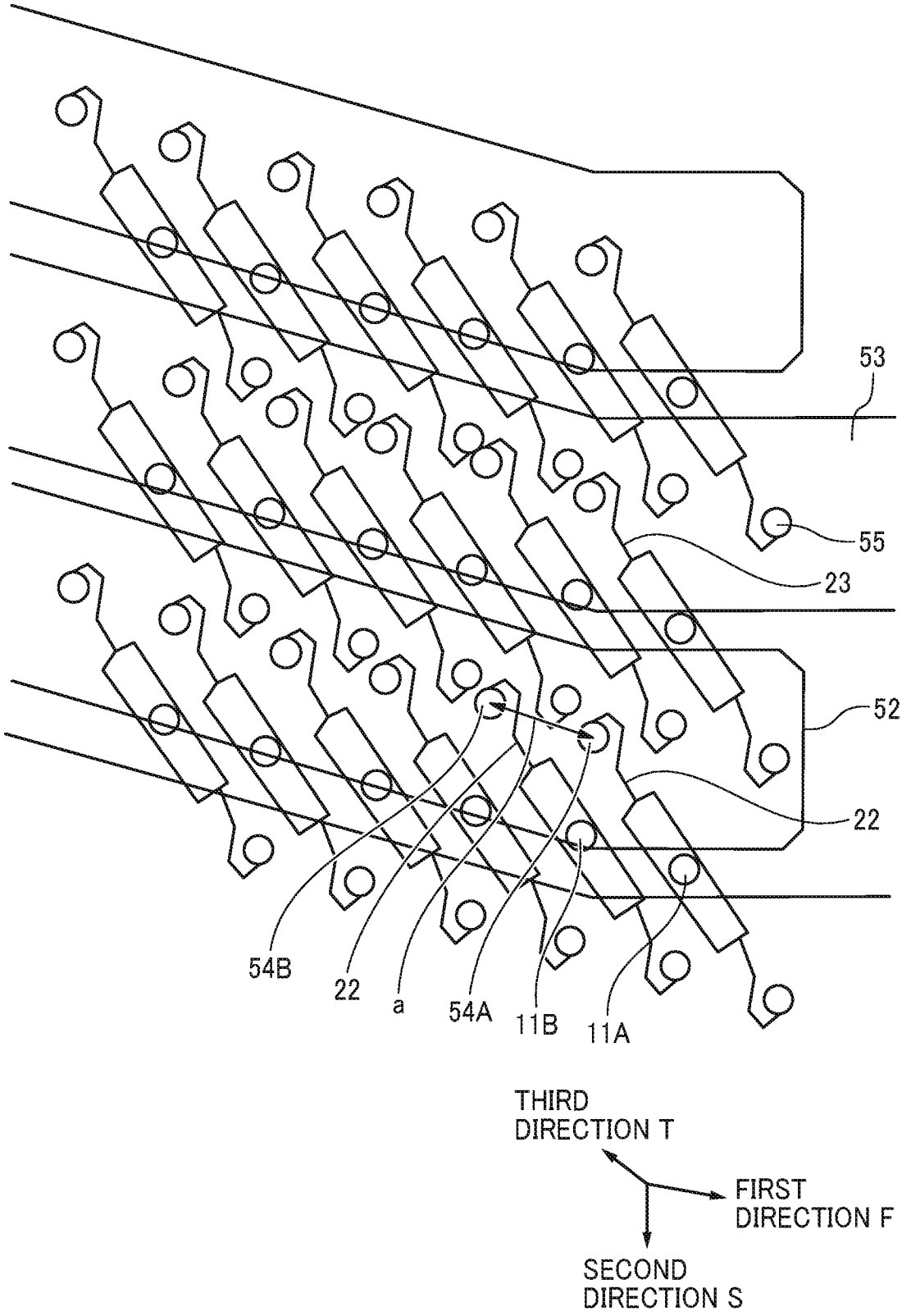
FIG. 12 is an enlarged plan view of a portion of the liquid discharge head according to a second embodiment of the present disclosure.

Next, a second embodiment is described with reference to FIG. 12. FIG. 12 is an enlarged plan view of a main part of the head 1 according to the second embodiment.

In the present disclosure, the first nozzle 11A and the second nozzle 11B that are the closest nozzles 11 are arranged in the first direction F along which the common-supply branch channel 52 extends. Further, the nozzle arrays are arranged in the second direction S, and the individual supply channels 22 and the individual collection channels 23 are arranged along the third direction T.

Also in a configuration illustrated in FIG. 12, the distance "a" between the first supply port 54 communicating with the first nozzle 11A and the second supply port 54B communicating with the second nozzle 11B is greater than the distance "b" from the supply port 54 to the supply-side damper 62 (a>b).

Thus, the head 1 can reduce pressure interference (mutual interference) with other nozzles 11 through the common-supply branch channel 52 and thus can reduce crosstalk.

Next, an example of a head module according to the present disclosure is described with reference to FIGS. 13 and 14.

Figure 13:
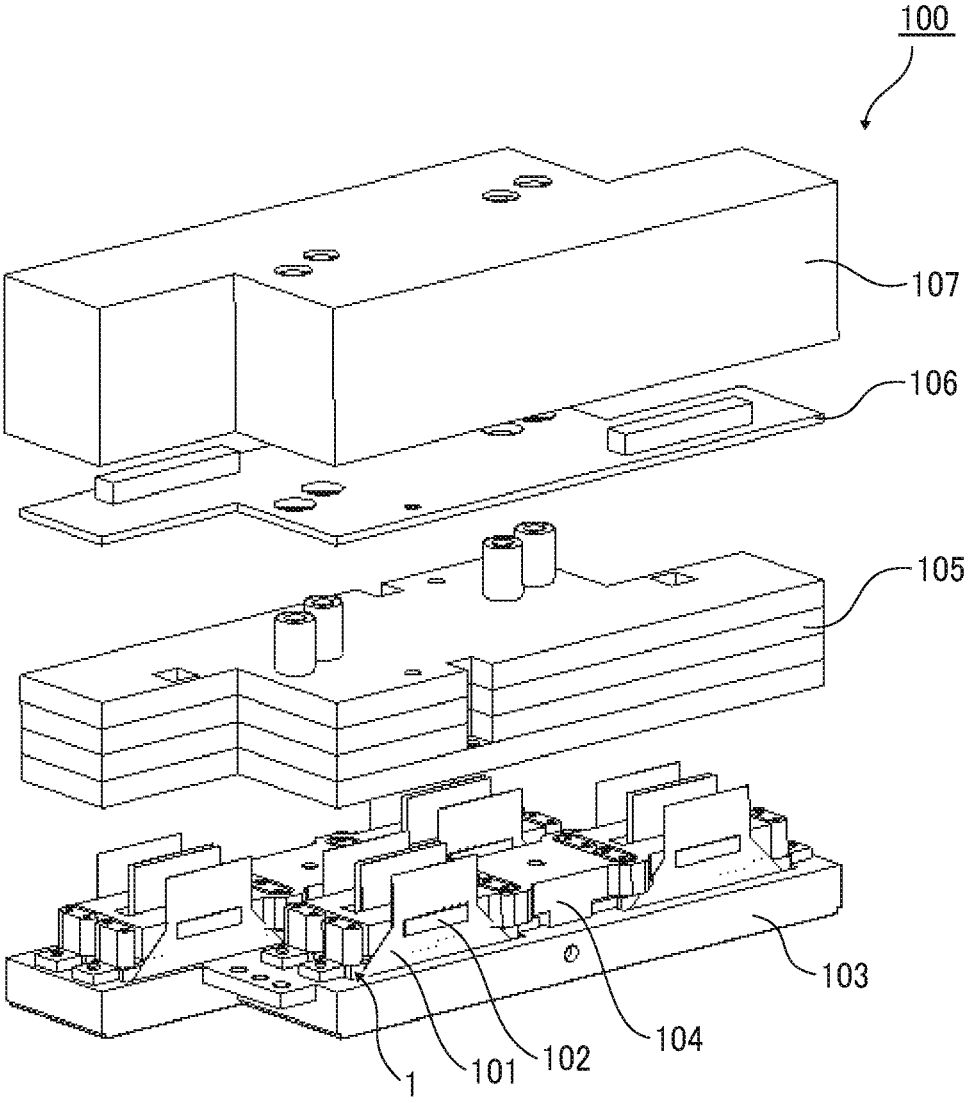
FIG. 13 is an exploded perspective view of a head module according to embodiments of the present disclosure.
Figure 14:
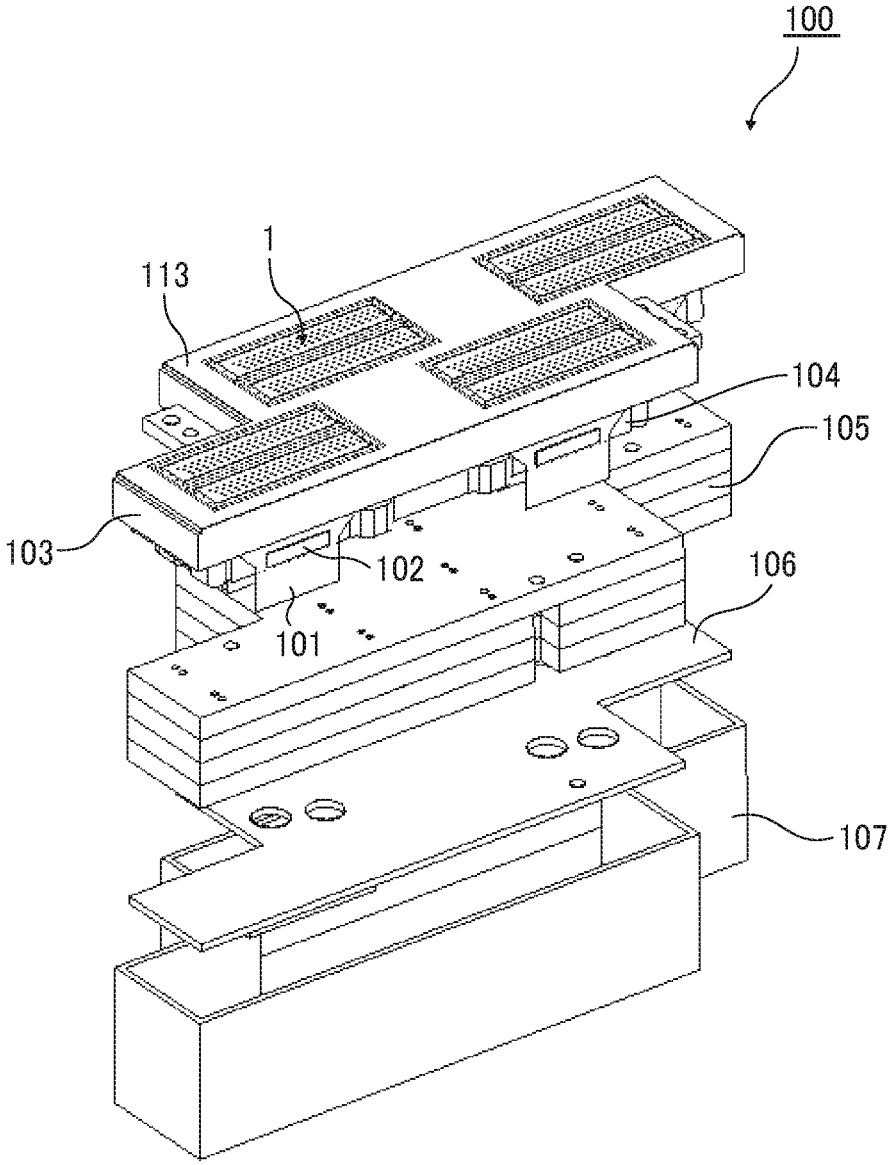
FIG. 14 is an exploded perspective view of the head module viewed from a nozzle surface of the head module.

FIG. 13 is an exploded perspective view of the head module 100. FIG. 14 is an exploded perspective view of the head module 100 viewed from the nozzle surface side of the head module 100.

The head module 100 includes a plurality of heads 1 configured to discharge a liquid, a base 103 that holds the plurality of heads 1, and a cover 113 serving as a nozzle cover of the plurality of heads 1.

Further, the head module 100 includes a heat radiator 104, a manifold 105 forming the channels to supply the liquid to the plurality of heads 1, a printed circuit board 106 (PCB) connected to the flexible wiring member 101 (substrate), and a module case 107.

Next, a liquid discharge apparatus according to embodiments of the present disclosure is described with reference to FIGS. 15 and 16.

Figure 15:
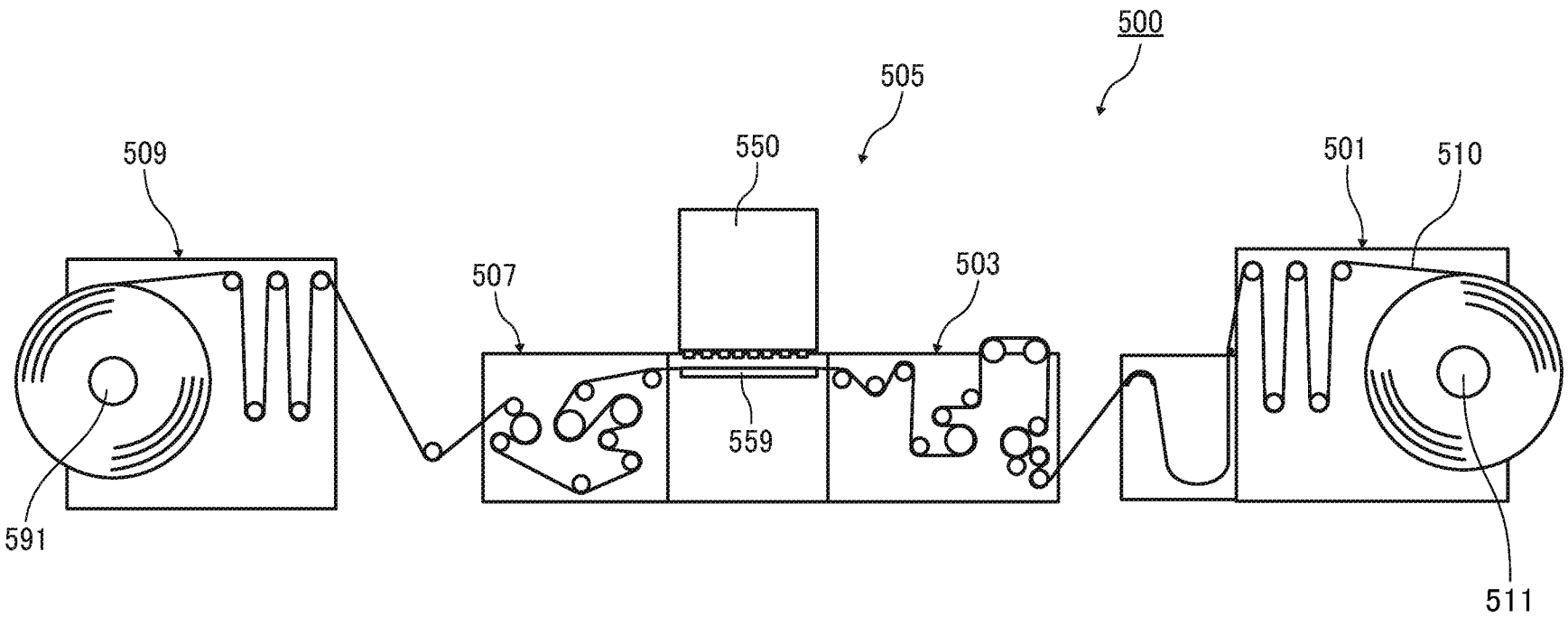
FIG. 15 is a schematic side view of a liquid discharge apparatus according to embodiments of the present disclosure.
Figure 16:
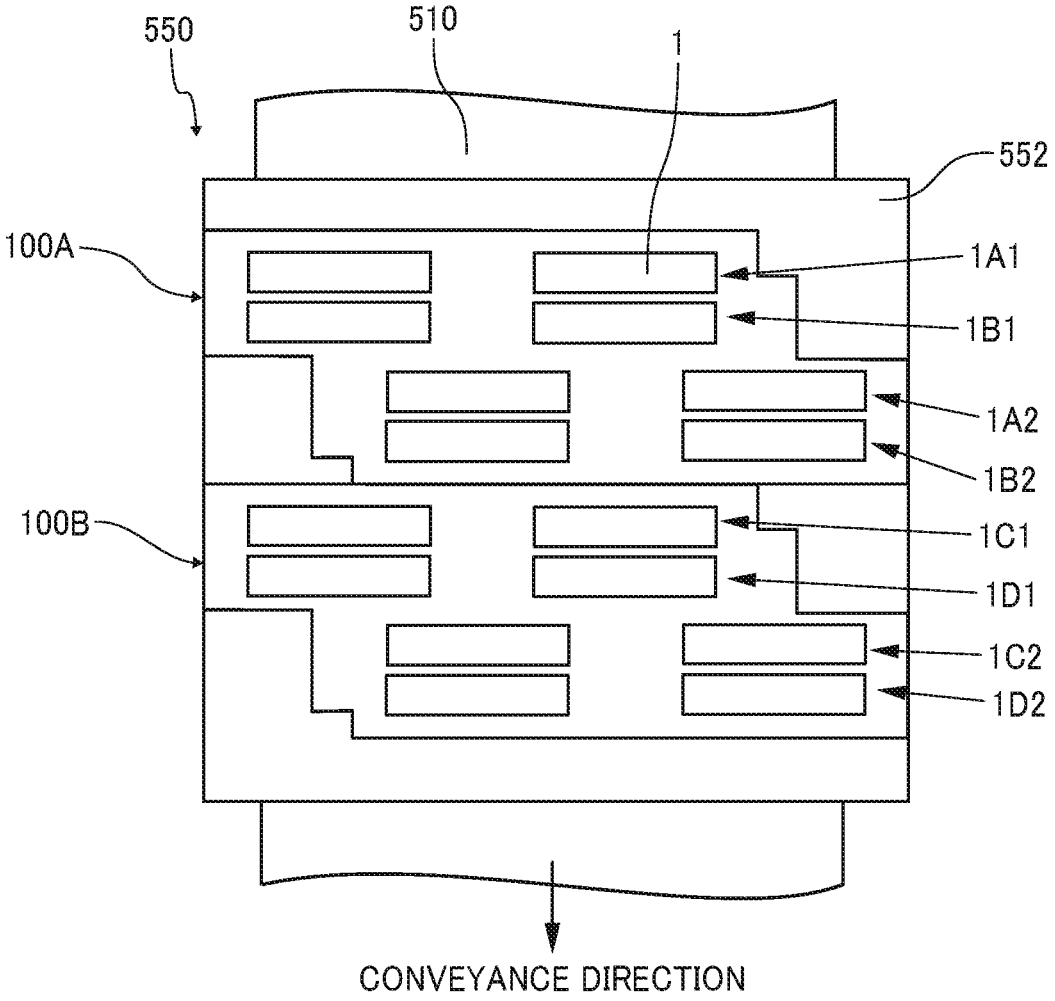
FIG. 16 is a plan view of a head unit of the liquid discharge apparatus of FIG. 15.

FIG. 15 is a side view of the liquid discharge apparatus according to the present disclosure. FIG. 16 is a plan view of a head unit of the liquid discharge apparatus of FIG. 15 according to the present disclosure.

A printing apparatus 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a head unit 550 on a conveyance guide 559. The head unit 550 discharges a liquid from the nozzles 11 of the head 1 to form an image on the continuous medium 510.

Here, in the head unit 550, two head modules 100A and 100B according to the present disclosure are provided in the common base member 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The head module 100B includes head arrays 1C1, 1D1, 1C2, and 1D2. Each of the head arrays 1C1, 1D1, 1C2, and 1D2 includes a plurality of heads 1 arranged in a direction perpendicular to a conveyance direction of the continuous medium 510.

The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

An example of a liquid circulation device employed in the liquid discharge apparatus according to the present disclosure is now described with reference to FIG. 17.

Figure 17:
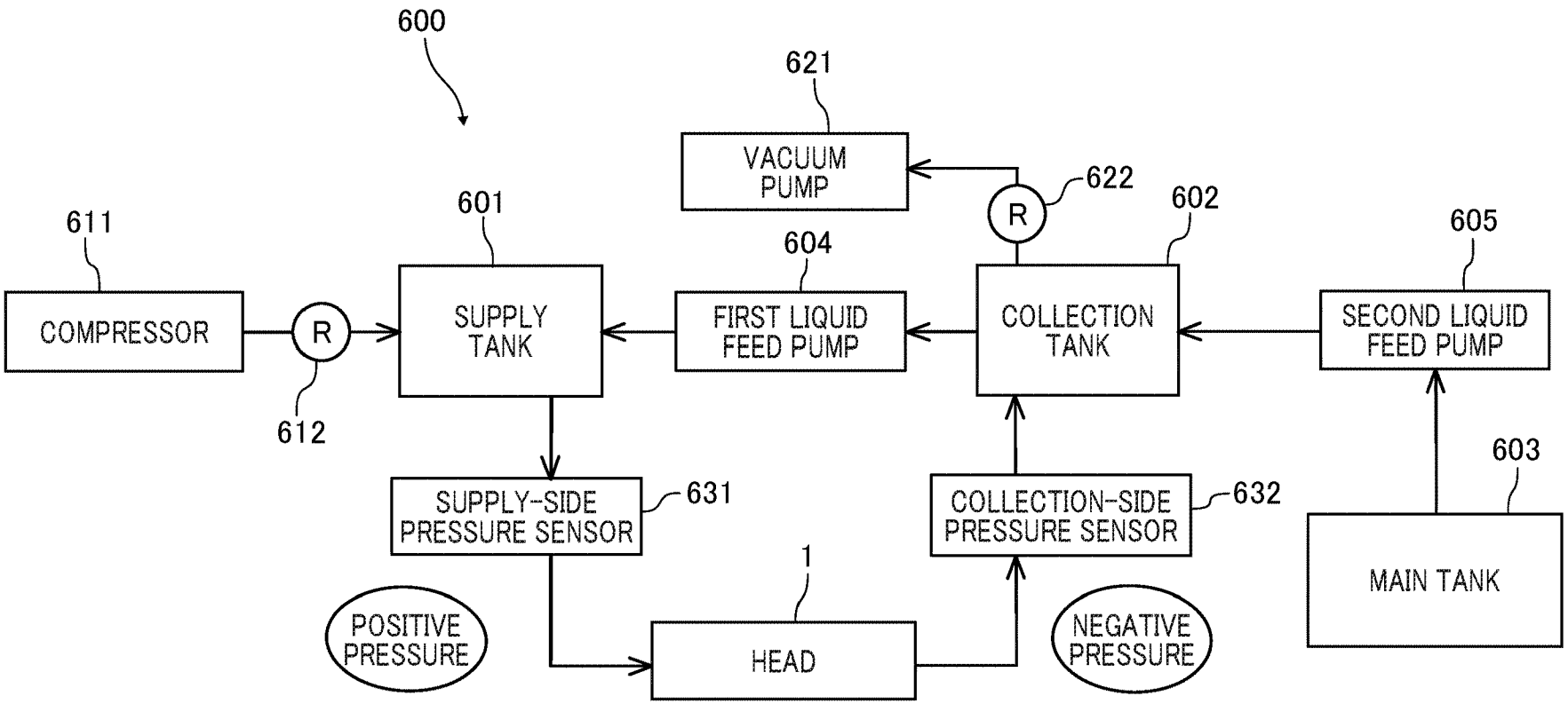
FIG. 17 is a block diagram illustrating an example of a structure of a liquid circulation device.

FIG. 17 is a block diagram illustrating the structure of the liquid circulation device. Although only one head 1 is illustrated in FIG. 17, in the structure including a plurality of heads 1 as illustrated in FIGS. 13 to 16, supply-side liquid channels and collection-side liquid channels are respectively coupled via manifolds or the like to the supply sides and collection sides of the plurality of heads 1.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, a collection-side pressure sensor 632, and the like.

The compressor 611 and the vacuum pump 621 together generate a difference between the pressure in the supply tank 601 and the pressure in the collection tank 602.

The supply-side pressure sensor 631 is disposed between the supply tank 601 and the head 1 and coupled to the supply-side liquid channel coupled to a supply port 81 of the head 1. The collection-side pressure sensor 632 is coupled to the collection-side liquid channel that is positioned between the head 1 and the collection tank 602 and coupled to a collection port 82 of the head 1.

One end of the collection tank 602 is coupled to the supply tank 601 via the first liquid feed pump 604, and the other end of the collection tank 602 is coupled to the main tank 603 via the second liquid feed pump 605.

Accordingly, the liquid flows from the supply tank 601 into the head 1 via the supply port 81 (see FIG. 1) and exits the head 1 from the collection port 82 (see FIG. 1) into the collection tank 602. Further, the first liquid feed pump 604 feeds the liquid from the collection tank 602 to the supply tank 601. Thus, the liquid circulation channel is constructed.

The supply tank 601 is coupled to the compressor 611 and controlled to keep the pressure detected by the supply-side pressure sensor 631 at a predetermined positive pressure. The collection tank 602 is coupled to the vacuum pump 621 and controlled to keep the pressure detected by the collection-side pressure sensor 632 at a predetermined negative pressure.

Such a configuration allows the menisci of ink to be maintained at a constant negative pressure while circulating liquid through the inside of the head 1.

When the liquid is discharged from the nozzles 11 of the head 1, the amount of liquid in each of the supply tank 601 and the collection tank 602 decreases. Accordingly, the collection tank 602 is replenished with the liquid supplied from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 in response to a detection result that the liquid level in the collection tank 602 is lower than a predetermined height.

Next, another example of a printing apparatus as a liquid discharge apparatus according to the present disclosure is described with reference to FIGS. 18 and 19.

Figure 18:
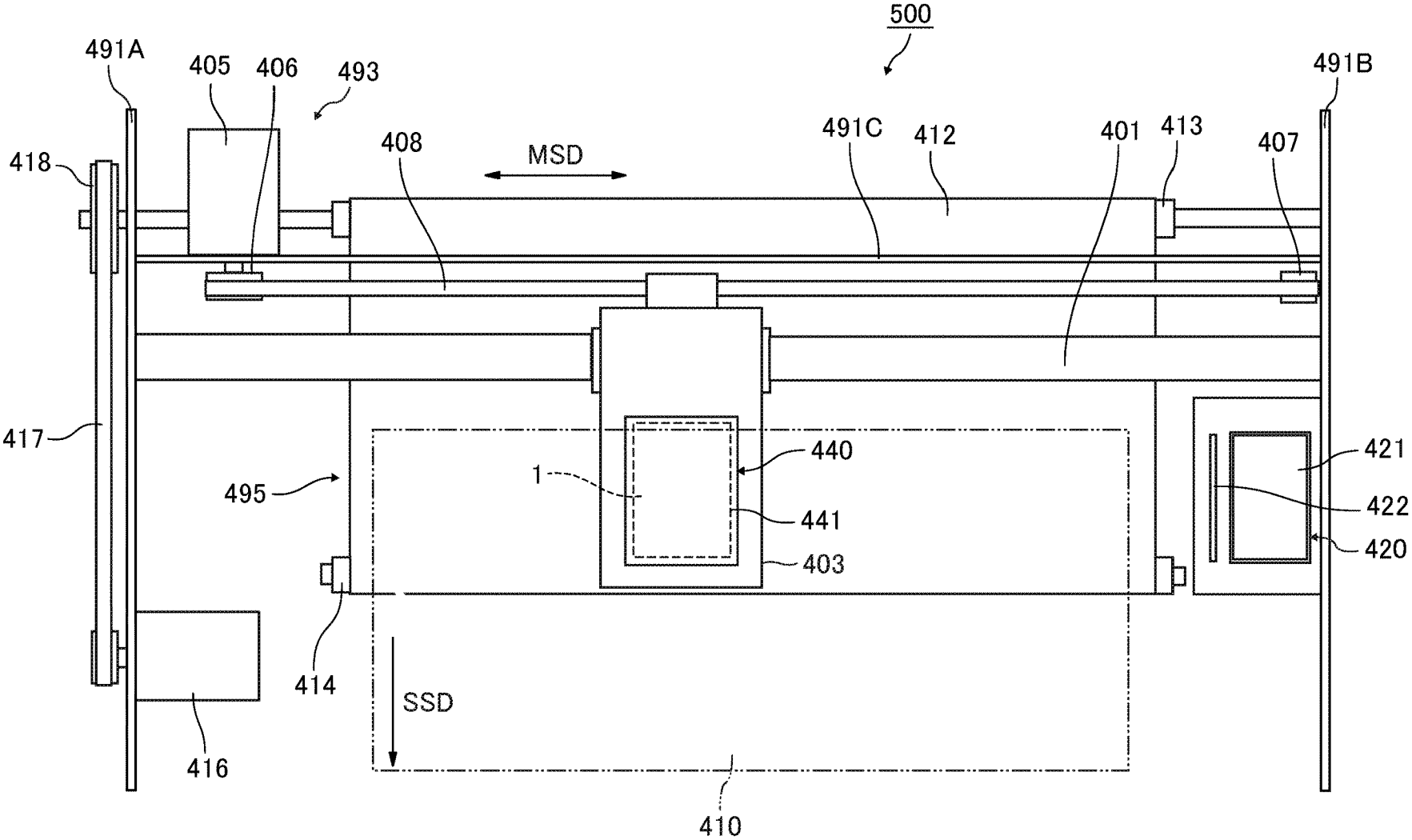
FIG. 18 is a plan view of a portion of a printer as a liquid discharge apparatus according to embodiments of the present disclosure.
Figure 19:
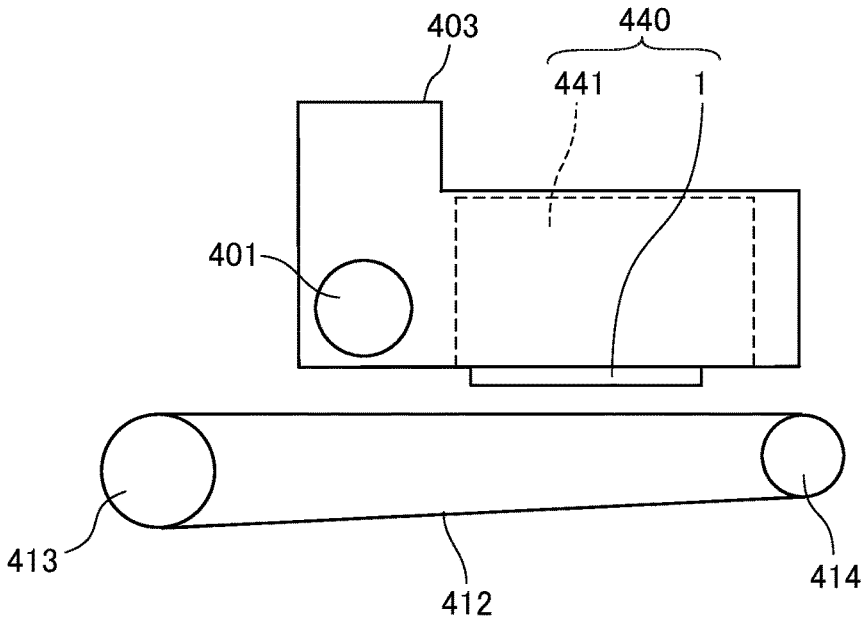
FIG. 19 is a side view of a portion of the liquid discharge apparatus of FIG. 18.

FIG. 18 is a plan view of a portion of the liquid discharge apparatus according to embodiments of the present disclosure. FIG. 19 is a side view of a portion of the liquid discharge apparatus of FIG. 18.

A printing apparatus 500 according to the present disclosure is a serial-type apparatus in which a main scan moving unit 493 reciprocally moves a carriage 403 in a main scanning direction indicated by arrow MSD in FIG. 18. The main scan moving unit 493 includes a guide 401, a main scanning motor 405, and a timing belt 408, for example. The guide 401 is bridged between a left-side plate 491A and a right-side plate 491B that movably holds the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present disclosure and a head tank 441 forms the liquid discharge device 440 as a single unit. The head 1 of the liquid discharge device 440 discharges liquid of each color, for example, yellow (Y), cyan (C), magenta (M), and black (K). The head 1 includes nozzle arrays each including a plurality of nozzles 11 arrayed in row in a sub-scanning direction, which is indicated by arrow SSD in FIG. 18, perpendicular to the main scanning direction MSD. The head 1 is mounted to the carriage 403 so that liquid is discharged downward.

The head 1 is connected to the above-described liquid circulation device 600 and circulated and supplied with liquid of a required color.

The printing apparatus 500 includes a conveyance unit 495 to convey a sheet 410. The conveyance unit 495 includes a conveyance belt 412 as a conveyance unit and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain the head 1 in good condition is disposed on a lateral side of the conveyance belt 412.

The maintenance unit 420 includes, for example, a cap 421 to cap a nozzle face of the head 1 and a wiper 422 to wipe the nozzle face.

The main scan moving unit 493, the maintenance unit 420, and the conveyance unit 495 are mounted to a housing that includes the left-side plate 491A, the right-side plate 491B, and a rear-side plate 491C.

In the printing apparatus 500 thus configured, the sheet 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

Figure 20:
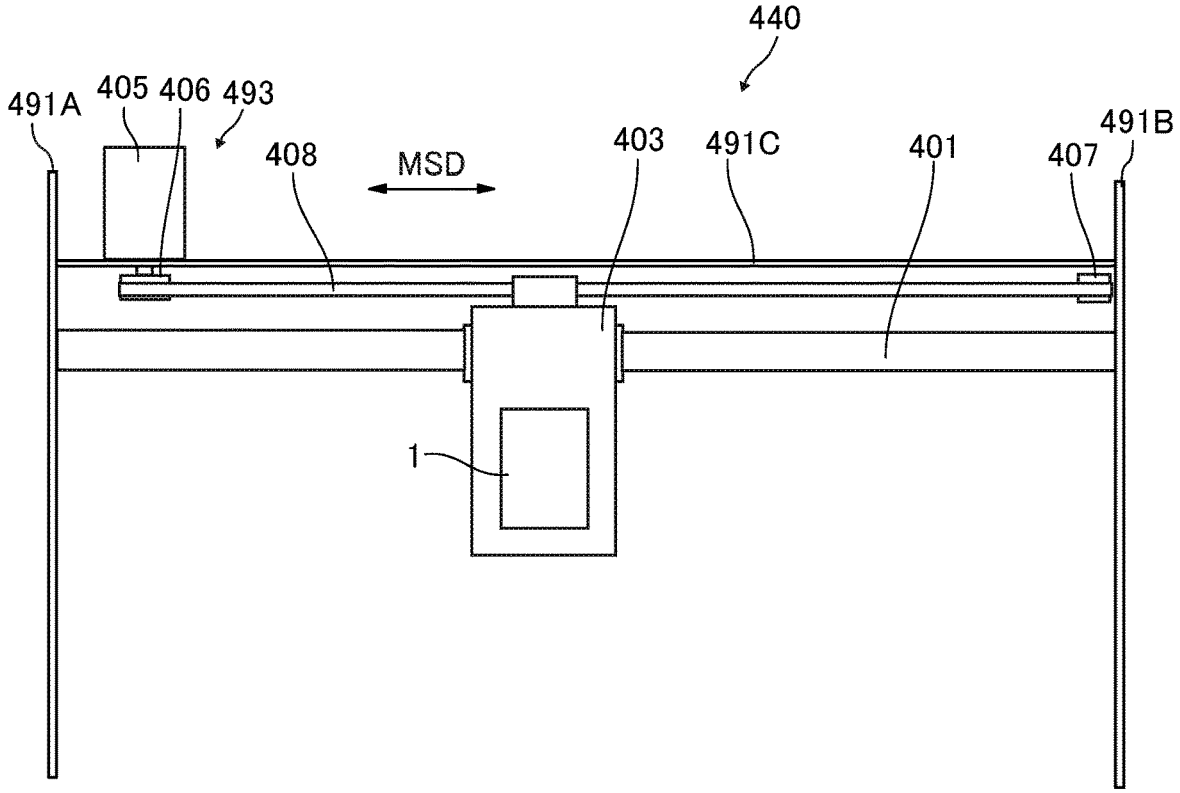
FIG. 20 is a plan view of a portion of another example of a liquid discharge device according to embodiments of the present disclosure.

Next, another example of the liquid discharge device according to the present disclosure is described with reference to FIG. 20. FIG. 20 is a plan view of a portion of another example of the liquid discharge device (liquid discharge device 440A).

The liquid discharge device 440 includes a housing, the main scan moving unit 493, the carriage 403, and the head 1 among components of the printing apparatus 500 as illustrated in FIG. 18. The left-side plate 491A, the right-side plate 491B, and the rear-side plate 491C forms the housing.

Note that, in the liquid discharge device 440, the maintenance unit 420 described above may be mounted on, for example, the right-side plate 491B.

Figure 21:
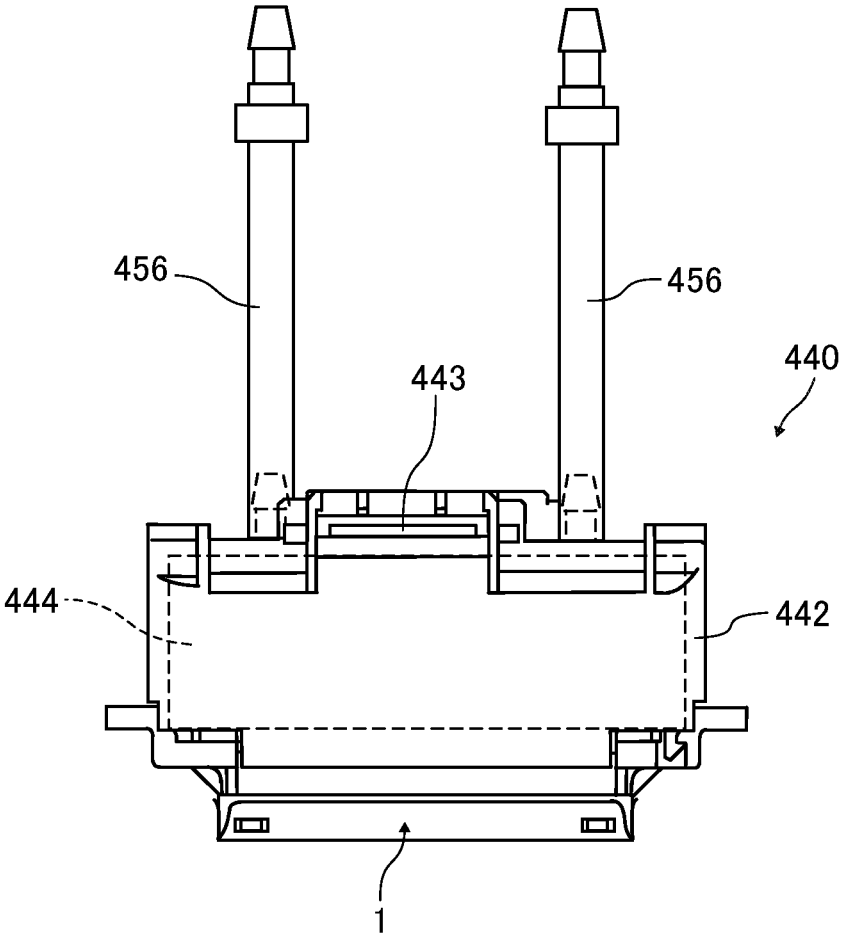
FIG. 21 is a front view of still another example of the liquid discharge device according to embodiments of the present disclosure.

Next, still another example of the liquid discharge device 440 according to embodiments of the present disclosure is described with reference to FIG. 21. FIG. 21 is a front view of still another example of the liquid discharge device 440.

The liquid discharge device 440 includes the head 1 to which a channel part 444 is mounted and a tube 456 connected to the channel part 444.

Further, the channel part 444 is disposed inside a cover 442. Instead of the channel part 444, the liquid discharge device 440 may include the head tank 441. A connector 443 electrically connected with the head 1 is provided on an upper part of the channel part 444.

In the present disclosure, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined with the head to form a single unit. For example, the "liquid discharge device" includes a combination of the head with at least one of a head tank, a carriage, a supply unit, a maintenance unit, and a main scan moving unit.

Examples of the "single unit" include a combination in which the head and one or more functional parts and devices are secured to each other through, e.g., fastening, bonding, or engaging, and a combination in which one of the liquid discharge head and the functional parts and devices is movably held by another. The liquid discharge head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the liquid discharge device may include the head and the carriage to form a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of the maintenance unit is secured to the carriage mounting the head so that the head, the carriage, and the maintenance unit form a single unit to form the liquid discharge device.

Further, in still another example, the liquid discharge device includes tubes connected to the head tank or the head mounting a channel member so that the head and a supply unit form a single unit. Through this tube, the liquid in the liquid storage source such as an ink cartridge is supplied to the head.

The main-scan moving unit may be a guide only. The supply unit may be a tube(s) only or a loading unit only.

In another example, the "liquid discharge device" may be a single unit in which the head and other functional parts are combined with each other. The "liquid discharge device" includes a head module including the above-described head, the head module, and head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid onto a powder material formed in layers to form a three-dimensional fabrication object.

The "liquid discharge apparatus" is not limited to an apparatus to discharge liquid to form meaningful images, such as letters or figures. For example, the liquid discharge apparatus may be an apparatus to form arbitrary images, such as arbitrary patterns, or to fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

The above-mentioned "material onto which liquid can be adhered" may be any material as long as liquid can temporarily adhere to, such as paper, thread, fiber, cloth, leather, metal, plastic, glass, wood, ceramics, or the like.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles to discharge a liquid;

a plurality of pressure chambers communicating with the plurality of nozzles, respectively;

a plurality of individual supply channels communicating with the plurality of pressure chambers, respectively;

a plurality of supply ports communicating with the plurality of individual supply channels, respectively;

a plurality of common-supply branch channels communicating with two or more of the plurality of individual supply channels through the plurality of supply ports, respectively;

a common-supply main channel communicating with the plurality of common-supply branch channels; and a plurality of supply-side dampers, each of the plurality of supply-side dampers forming a part of a wall of each of the plurality of common-supply branch channels, respectively;

wherein the plurality of nozzles includes a first nozzle and a second nozzle disposed closest to the first nozzle, the plurality of supply ports includes a first supply port communicating with the first nozzle and a second supply port communicating with the second nozzle, the first supply port and the second supply port are arranged in an identical one of the plurality of common-supply branch channels, and the first supply port and the second supply port are spaced apart by a distance greater than a distance between one of the first supply port and the second supply port and one of the plurality of supply-side dampers facing the one of the first supply port and the second supply port.

2. The liquid discharge head according to claim 1, wherein the plurality of supply ports further includes a third supply port, the third supply port being arranged in the identical one of the plurality of common-supply branch channels, and the third supply port and one of the first supply port and the second supply port are spaced apart by a distance shorter than the distance between the first supply port and the second supply port.

3. The liquid discharge head according to claim 1, wherein the plurality of supply-side dampers faces the plurality of the supply ports, respectively.

4. The liquid discharge head according to claim 1, further comprising:

a plurality of individual collection channels communicating with the plurality of pressure chambers, respectively;

a plurality of collection ports communicating with the plurality of individual collection channels, respectively;

a plurality of common-collection branch channels communicating with two or more of the plurality of individual collection channels through the plurality of collection ports, respectively;

a common-collection main channel communicating with the plurality of common-collection branch channels; and a plurality of collection-side dampers, each of the plurality of collection-side dampers forming a part of a wall of each of the plurality of common-collection branch channels.

5. The liquid discharge head according to claim 4, wherein the plurality of nozzles includes a third nozzle and a fourth nozzle disposed closest to the third nozzle;

the plurality of collection ports includes a first collection port communicating with the third nozzle and a second collection port communicating with the fourth nozzle;

the first collection port and the second collection port are arranged in an identical one of the plurality of common-collection branch channels;

the plurality of collection ports further includes a third collection port, the third collection port being arranged in the identical one of the plurality of common-collection branch channels; and the third collection port and one of the first collection port and the second collection port are spaced apart by a distance shorter than the distance between the first collection port and the second collection port.

6. The liquid discharge head according to claim 5, wherein the first collection port and the second collection port are spaced apart by a distance greater than a distance between one of the first collection port and the second collection port and one of the plurality of collection-side dampers facing the one of the first collection port and the second collection port.

7. The liquid discharge head according to claim 4, wherein the plurality of common-supply branch channels and the plurality of common-collection branch channels alternate to be adjacent with each other.

8. The liquid discharge head according to claim 4, wherein the plurality of collection-side dampers faces the plurality of collection ports, respectively.

9. The liquid discharge head according to claim 4, wherein an identical damper member forms the plurality of supply-side dampers and the plurality of collection-side dampers; and each of the plurality of common-supply branch channels and the plurality of common-collection branch channels is formed of the identical damper member sealing grooves formed on an identical common channel member.

10. The liquid discharge head according to claim 9, wherein the plurality of common-supply branch channels and the plurality of common-collection branch channels alternate in an identical common channel member; and a direction of arrangement of the plurality of common-supply branch channels and the plurality of common-collection branch channels is identical to a direction of arrangement of the plurality of nozzles.

11. A liquid discharge device comprising the liquid discharge head according to claim 1.

12. The liquid discharge device according to claim 11, wherein the liquid discharge head and at least one of a head tank to store the liquid to be supplied to the liquid discharge head, a carriage on which the liquid discharge head is mounted, a supply unit to supply the liquid to the liquid discharge head, a maintenance unit to maintain the liquid discharge head, and a main scan moving unit to move the liquid discharge head in a main scanning direction form a single unit.

13. A liquid discharge apparatus comprising the liquid discharge device according to claim 11.

14. A head module comprising:

a plurality of the liquid discharge heads according to claim 1; and a base to hold the plurality of liquid discharge heads.

* * * * *